US007737937B2

(12) United States Patent
Fisekovic et al.

(10) Patent No.: US 7,737,937 B2
(45) Date of Patent: Jun. 15, 2010

(54) SCANNING BACKLIGHT FOR A MATRIX DISPLAY

(75) Inventors: Nebojsa Fisekovic, Eindhoven (NL); Jeroen Hubert Christoffel Jacobus Stessen, Eindhoven (NL); Franciscus Johannes Stommels, Eindhoven (NL); Carsten Deppe, Aachen (DE); Ulrich Boeke, Langerwehe (DE); Peter Luerkens, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 883 days.

(21) Appl. No.: 11/568,986

(22) PCT Filed: May 9, 2005

(86) PCT No.: PCT/IB2005/051501

§ 371 (c)(1),
(2), (4) Date: Nov. 13, 2006

(87) PCT Pub. No.: WO2005/111976

PCT Pub. Date: Nov. 24, 2005

(65) Prior Publication Data

US 2008/0259020 A1 Oct. 23, 2008

(30) Foreign Application Priority Data

May 14, 2004 (EP) ..... 04102132

(51) Int. Cl.
*G09G 3/36* (2006.01)

(52) U.S. Cl. ..... 345/102; 345/207

(58) Field of Classification Search ..... 345/102, 345/207, 211; 315/149; 349/70, 72
See application file for complete search history.

(56) References Cited

U.S. PATENT DOCUMENTS 6,081,073 A 6/2000 Salam (Continued)

FOREIGN PATENT DOCUMENTS

GB 2378344 A 2/2003

(Continued)

OTHER PUBLICATIONS

Written Opinion of the International Searchint Authority PCT/IB2005/051501.

(Continued)

*Primary Examiner*—Kevin M Nguyen

(57) ABSTRACT

A scanning backlight unit (BU) for a matrix display comprises a plurality of light sources (L1, . . . , Ln). A driver (2) supplies drive signals (D1, . . . , Dn) to the light sources (L1, . . . , Ln). A controller (3) controls the driver (2) to separately activate the light sources (L1, . . . , Ln) to obtain light-emitting regions (5) being active. A light sensor (4) is associated with a group of at least two of the light sources (L1, . . . , Ln) to supply a sensor signal (SES) which indicates a luminance (LU) of the group. The controller (3) reads the sensor signal (SES) at different instants (ts1, . . . , tsn) at which mutually different subsets of the light sources (L1, . . . , Ln) of the group are active to control the driver (2) to supply power levels to the light sources (L1, . . . , Ln) of the group to obtain a luminance (LU1, . . . , LUn) of each one of the light sources (L1, . . . , Ln) of the group in dependence on the sensor signal (SES).

22 Claims, 5 Drawing Sheets

U.S. PATENT DOCUMENTS 6,094,185 A * 7/2000 Shirriff ..... 345/102
6,157,143 A 12/2000 Bigio et al.
6,611,000 B2 8/2003 Tamura et al.
2002/0000960 A1 1/2002 Yoshihara et al.
2002/0057238 A1 5/2002 Nitta et al.
2002/0070914 A1 6/2002 Bruning et al.
2003/0016205 A1 1/2003 Kawabata et al.
2003/0122771 A1 7/2003 Sumiyoshi et al.
2004/0041756 A1 3/2004 Henmi et al.
2004/0252097 A1 * 12/2004 Kaneki et al. ..... 345/102

FOREIGN PATENT DOCUMENTS

WO 03077013 A2 9/2003

OTHER PUBLICATIONS

ISR, International Search Report PCT/IB2005/051501WO.

* cited by examiner

SCANNING BACKLIGHT FOR A MATRIX DISPLAY

FIELD OF THE INVENTION

The invention relates to a scanning backlight unit for a matrix display, an apparatus comprising such a scanning backlight unit, and a method of illuminating a matrix display.

BACKGROUND OF THE INVENTION

US 2003/0016205-A1 discloses a lighting unit for use as a backlight of a liquid crystal display device. The backlight is locally turned on, for part of the frame period only, to reduce smear effects occurring for moving images. Such a backlighting is usually referred to as scanning backlighting. The lighting unit comprises a plurality of light sources and associated light-emitting regions that are arranged in the vertical scanning direction of the liquid crystal display. Thus, in the direction in which the multiple gate lines, which select rows of pixels of the display, are driven sequentially. The light emitting sources associated with the light-emitting regions are sequentially turned on and off synchronously with the scanning of the lines of pixels. A light sensitive element is associated with each one of the light-emitting sources. The light sensitive element feeds-back the luminance of the associated light-emitting source to a control circuit which changes the drive signal supplied to the light-emitting source to minimize the difference in luminance between the respective light-emitting regions.

Thus, the scanning backlight produces instead of a constant light plane for constantly illuminating the complete matrix display, light areas which are present for a relatively short period in time only. The relatively short period is shorter than a frame period. This has the advantage that the integration by the human eye which tracks a moving object decreases and thus the smearing becomes less visible. Further, the switching periods wherein the pixels of the matrix display change their optical behavior can be selected to occur when no light is impinging. Usually, in a scanning backlight, the light of a particular one of the light sources has to be concentrated in the associated one of the light-emitting regions; the light should not be divided over the complete area of the matrix display. Consequently, differences in the luminance of the light sources will become quite visible.

SUMMARY OF THE INVENTION

It is an object of the invention to provide a scanning backlight unit for a matrix display in which less light sensors are required.

A first aspect of the invention provides a scanning backlight unit for a matrix display as claimed in claim 1. A second aspect of the invention provides an apparatus comprising such a scanning backlight unit as claimed in claim 21. A third aspect of the invention provides a method of illuminating a matrix display as claimed in claim 22. Advantageous embodiments are defined in the dependent claims.

In a scanning backlight unit, light sources are arranged in different light-emitting regions. The light sources are activated separately, for example successively, to obtain light-emitting regions which are active in accordance with the associated light sources. Usually, the light sources are activated in synchronization with the frame scanning of the matrix display. For example, the light sources are activated all once during a frame period. Now, the frame scanning of the matrix display is performed by selecting the lines of pixels, usually the rows, one by one. After one frame period all lines of pixels have been selected once and the image displayed is refreshed. Alternatively, the light sources may be activated a plurality of times during the frame period of the image to be displayed or even asynchronously. If relevant, a period in time required for a repetitive sequence of activating all the light sources (L1, . . . , Ln) is referred to as the scan period. The scan period thus may last a multiple times the duration of the frame period, or may even not be related to the frame period. For the ease of elucidation, in the now following, the scan period is identical to the frame period.

The light sources and their light-emitting regions may cover a single line of pixels or a group of consecutive lines of pixels. This means that the light emitted by a particular one of the light sources is concentrated in the associated light-emitting region. However, part of the light will also be present outside the light-emitting region. For example, if the luminance of a particular light source in the center of its associated light-emitting region is 100%, in the center of an adjacent light-emitting region the luminance of this particular light source may be 50%. Generally, the light sources are activated one after the other and each is active during only part of the frame period. Or said differently, although several light sources may be activated successively, at a predetermined instant all may be active. In a scanning backlight unit, every light source must be switched off during at least a part of the frame period. Therefore, it is always possible to determine different instants at which different light sources are active. Thus, the contribution to the luminance of each light source separately can be determined at the position of the single light sensor. Consequently, for example, deviations from a desired value of the luminance can be corrected for each light source. The deviations are corrected by changing the power supplied to the light sources in dependence on the sensor signal. The deviations may be caused by aging, different load, changing temperature, and tolerances of the light sources.

It has to be noted that a light source may consist of a single light generating element or several light generating elements. With light-emitting region is meant the region corresponding to the single light generating element or the region corresponding to the several light generating elements of the light source wherein the light of the light source is concentrated. The light emitting region is not the light receiving region of the light source. Usually, the light receiving region is larger than the light emitting region. Thus, a light emitting region is active when the light source or light sources associated with this region produce light. The light sources may be of any kind. For example, a light emitting region may be associated with a single lamp, or with a group of lamps, or with a row or a matrix of LED's (light emitting diodes) or other small light emitting devices.

In an embodiment in accordance with the invention as claimed in claim 2, the controller uses the luminance levels sensed by the light sensor to control the power levels such that a desired luminance of each one of the light sources is obtained. This is possible because it is known which light sources are producing light at each instant a sensing signal is obtained and what the contribution factor of each one of these active light sources is at the position of the sensor. The contribution factor depends on the distance between the active light source and the sensor and usually is predetermined by the construction of the reflector used.

In an embodiment in accordance with the invention as claimed in claim 3, a comparator compares the sensor signal (or a signal derived from the sensor signal) at the different sensing instants with pre-stored values. The controller controls the power levels to obtain the desired luminance at the different sensing instants as indicated by the pre-stored values. Thus, for each instant might be stored which luminance should be reached at the position of the sensor if all the light sources which are active at this instant produce the same luminance. If deviations are detected, it can be determined which light source(s) is (are) causing this deviation, and the power level(s) supplied can be varied to compensate for the deviation.

In an embodiment in accordance with the invention as claimed in claim 4, the equations which define the contributions to the sensed luminance at the different instants can be solved and the power level(s) supplied can be adjusted to obtain the desired luminance levels at these sensing instants. At each one of the different instants, the sensed luminance is equal to a weighted sum of functions. The weighting factors in this sum are determined by the distance between the different light sources and the sensor and thus are the contribution factors mentioned hereinbefore.

Each one of the functions represents the luminance of an associated one of the light sources as function of the power level supplied to this light source. These functions may be linear functions or more complex functions. The functions may contain multiplications of coefficients and terms of the power which is supplied to the light sources. The terms of the power may be powers of the power such that a polynomial is obtained or may be more complex terms such as logarithmic terms. Usually, for a particular type of light sources, the structure of the functions is known while the coefficients may vary over time, for example due to aging or temperature effects. Because at each sensing instant it is known which functions contribute to the sensed luminance, what the functions are, what the sensed luminance is, and what the weighting factors are, a system of equations is obtained from which the coefficients can be determined. By regularly repeating the sensing cycles it is possible to determine the correct coefficients even if these coefficients change over time. If the correct coefficients have been determined, the power levels to be supplied to the light sources can be adapted such that a desired luminance of each one of the light sources is obtained. Preferably, the desired luminance is identical for each light source and is kept identical over time. Very complex functions may make it very difficult to solve the coefficients from the system of equations. Therefore, these complex functions are preferably approximated by a polynomial with as less terms as possible.

In an embodiment in accordance with the invention as claimed in claim 5, the predetermined weighting factors and the functions are stored in a memory. The values of the weighting factors for the different light sources and the functions may be determined experimentally. Usually, if the light sources are identical, the functions used have the same structure and only differ in their coefficients. Now, instead of the complete functions, it may suffice to store the coefficients of each function and a single algorithm which represents the structure of the single function.

In an embodiment in accordance with the invention as claimed in claim 6, at each of the sensing instants, the controller controls the driver to supply a predetermined power level to all active light sources. If the functions and the coefficients of the functions are known, it is possible to determine the weighting factors from the system of equations. This is especially simple if the functions are substantially identical by fact, for example at the start of use of the system. Now, a simple test sense phase suffices to accurately determine the weighting factors. The predetermined power levels may be identical for all the light sources.

In an embodiment in accordance with the invention as claimed in claim 7, the controller controls the driver to supply a predetermined power level to the light sources one by one. Thus, during this test cycle, the light sources are activated one by one. Now a simple algorithm can be used. It is known that at each sensing instant the light sensed by the sensor is emitted by a single light source only. Consequently, only the associated function multiplied by its associated weighting factor contributes to the sensed luminance. If the function comprises one coefficient only, it is possible to determine this coefficient directly at a single known power supplied to the light source. It is not required to solve a system of equations. If the function is more complex and comprises several coefficients, a number of sense operations at different power levels is required during the period in time that only this light source is emitting light. Now only this system of equations has to be solved. If more light sources are active at a same sensing instant a very complex system of equations may result.

It has to be noted that the functions so far are time invariant during the sensing period. The luminance is determined as function of the power supplied to the light source and it is assumed that the function does not change while the several values of the luminance are sensed. It is also possible to determine a time behavior of the function during the sensing period as is elucidated with respect to claim 11.

In an embodiment in accordance with the invention as claimed in claim 8, if the luminance of a particular light source is sampled once it is possible to determine a single coefficient of a single term of the function. This is for example relevant if the function is largely known. For example, if the function is a polynomial with only a single coefficient of a linear or higher order term.

In an embodiment in accordance with the invention as claimed in claim 9, if the behavior of the light source is more complex, the polynomial function may comprise more than one term with associated coefficients. Now, the luminance of the same light source should be sensed at different power levels to be able to determine the plurality of coefficients defining the function.

In an embodiment in accordance with the invention as claimed in claim 10, the calculator determines the functions by using the sensor signal at corresponding instants in different scan (for example, frame) periods at which different power levels are supplied to the active ones of the light sources. Thus, now, the luminance is known for the same sum of functions at different power levels, and consequently, it is possible to determine more coefficients of a more complex function.

In an embodiment in accordance with the invention as claimed in claim 11, for a same group of active light sources, the luminance is sampled at different instants to be able to determine the time behavior of the luminance and thus the associated function.

In an embodiment in accordance with the invention as claimed in claim 12, in different scan periods, the same light source is driven to supply a different luminance but at different duty cycles of the drive signal such that the integral is constant and this variation of the luminance is invisible. For example, the duty cycle may be enlarged while the current is decreased such that the multiplication of the duty cycle and the current level is substantially constant. This has the advantage that it is possible to define more complex functions because sensor signals for different luminance values can be used to determine the coefficients.

In an embodiment in accordance with the invention as claimed in claim 13, only a single light sensor is required for the complete backlight unit. Thus, a minimum number of light sensors is required, this in contrast to the prior art US 2003/0016205 A1, wherein a light sensor is required for each light source. The single light sensor in accordance with the present invention has to be positioned to receive light of each one of the light sources.

Alternatively, it is also possible to use multiple light sensors, each one for a group of at least two light sources. This has the advantage that the difference in distance between the position of the light sensor and the associated light sources becomes smaller. The luminance difference to be sensed is smaller, and it is not required to position the sensors to receive light from each light source. Alternatively, if each of the sensors receives light of each of the light-emitting regions, the contribution of each light-emitting region is known at all position of the sensors. This has the advantage that deviations in the lighting system can be minimized. Such deviations may be caused by tolerances in the reflector or the position of the light sources with respect to the reflector, or by local pollution of the reflector or light sources. Still, substantially less sensors are required than in the prior art wherein a sensor is required for each one of the lamps.

In an embodiment in accordance with the invention as claimed in claim 14, in a color display, the light sources comprise different light emitting elements which produce light of different colors. For, example, in a full color display each one of the light sources may comprise a red, green and a blue light emitting element which are activated sequentially in time. The full color display may comprise more than 3 sub-pixels per pixel, for example, a pixel may comprise a red, green, blue, and white sub-pixel. A single sensor which is sensitive to all the different colors is able to provide the sensed luminance for each one of the sequentially driven different colored light sources. Thus, for each one of the different colored light sources a same approach can be followed as discussed hereinbefore.

In an embodiment in accordance with the invention as claimed in claim 15, different sensors are used for the different colors light. This has the advantage that more sensitive sensors can be used.

In an embodiment in accordance with the invention as claimed in claim 16, the sensed values of the different colors are used to keep the ratios of the luminance values of the different colors constant over time. Thus, also the color reproduction can be made independent on aging or temperature effects of the light sources.

These and other aspects of the invention are apparent from and will be elucidated with reference to the embodiments described hereinafter.

DETAILED DESCRIPTION OF THE PREFERRED EMBODIMENT

Figure 1:
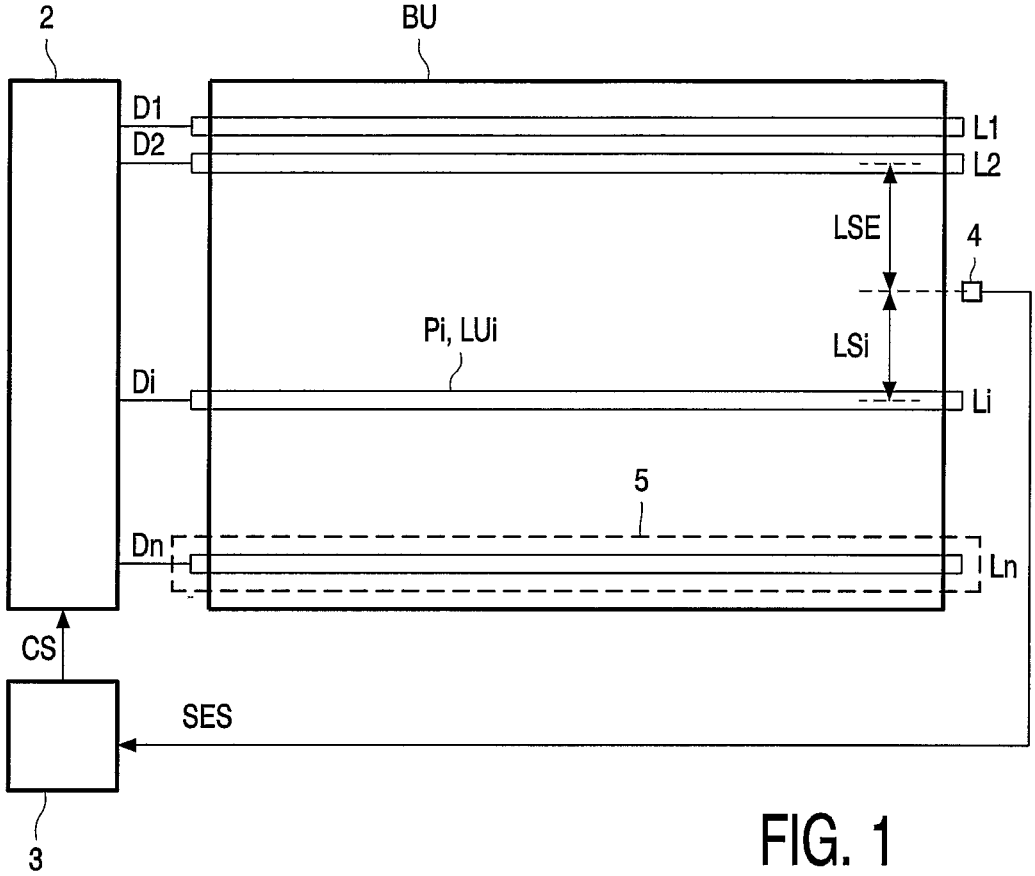
FIG. 1 shows a scanning backlight unit for a matrix display with a single light sensitive sensor.
Figure 7:
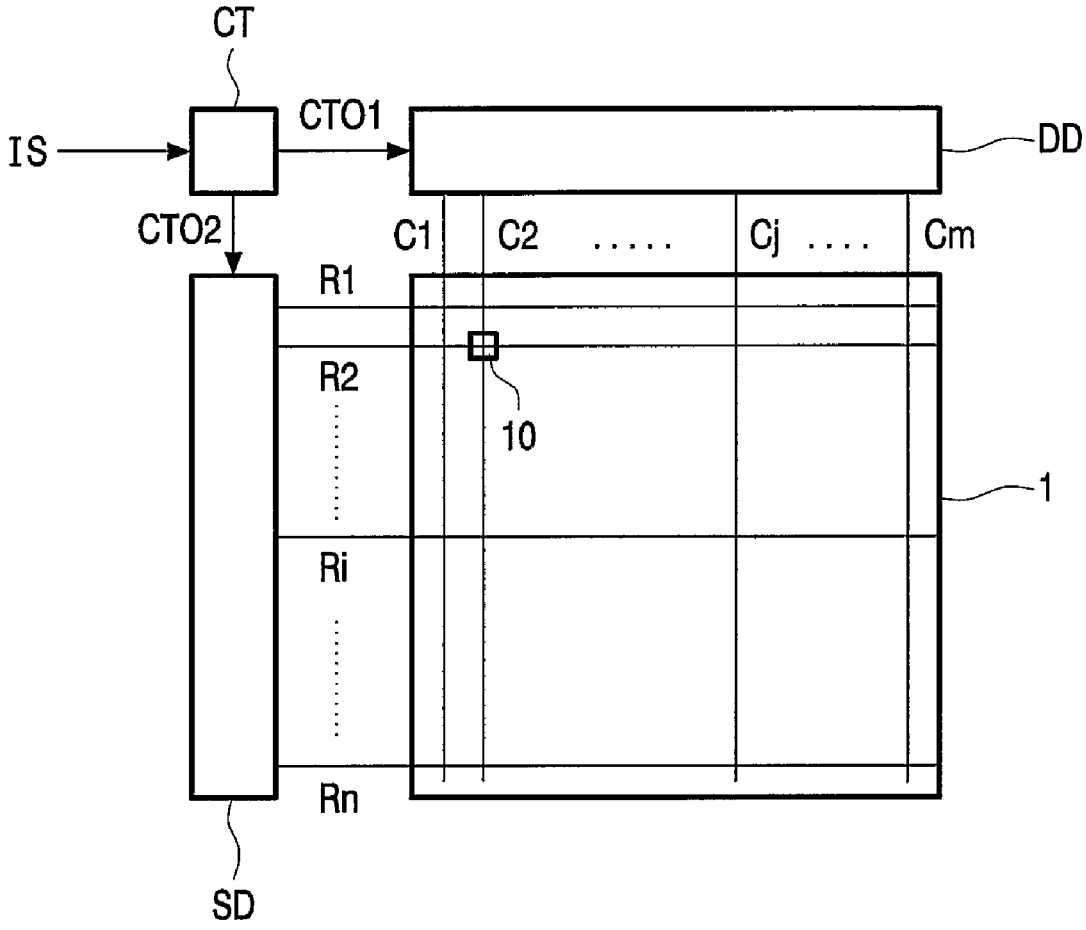
FIG. 7 shows a matrix display comprising a scanning backlight unit.

FIG. 1 shows a scanning backlight unit (BU) for a matrix display 1 as shown in FIG. 7. The scanning backlight unit (BU) comprises a single light sensitive sensor (4) only. The scanning backlight unit BU further comprises a plurality of light sources L1 to Ln, which, by way of example, are shown to be single elongated lamps. The light sources L1 to Ln are collectively also referred to as Li. The light-emitting regions 5 are the regions which are associated with a single light source Li. With each light-emitting region 5 more than one light source Li may be associated. For example, a single light-emitting region 5 may comprise several lamps which each may emit different colored light. Alternatively, a single light-emitting region 5 may comprise a row, or several rows of light emitting elements, such as light emitting diodes.

The light-emitting regions 5 preferably cover at least one row of pixels of the matrix display. In a normal matrix display wherein the rows extend in the horizontal direction, the light-emitting regions 5 also extend in the horizontal direction. In a transposed display wherein the rows extend in the vertical direction, the light-emitting regions 5 should also extend in the vertical direction. Although the light of the light source Li is concentrated in the light-emitting region 5, part of the light will occur outside the light-emitting region 5. In a scanning backlight unit (BU), usually, the amount of light of the light source rapidly decreases with the distance from its associated light-emitting region 5. The term light-emitting region 5 is especially used to make clear that a single light source Li corresponds to its associated light region 5, and that the light source Li may comprise a plurality of light-emitting elements which also correspond to the same associated light region 5.

A driver 2 supplies drive signal D1 to Dn to the light sources L1 to Ln, respectively. The drive signals D1 to Dn are collectively also referred to as Di. The light sources L1 to Ln are activated in synchronization with the scanning of the row of pixels 10 of the matrix display 1 (see FIG. 7). The light sensitive sensor 4 is arranged at a position such that it receives the light of all the light sources Li. The output signal of the light sensitive sensor 4 is the sensed signal SES. This sensed signal SES is supplied to a controller 3 which supplies a control signal CS to the driver 2. The distance between the second light source L2 and the sensor 4 is indicated by LSE. The distance between the sensor 4 and the light source Li is referred to as LSi. The sensed signal SES depends on the distance LSi between the sensor 4 and the light source Li, the power supplied to the light source Li, the number of light sources Li which are active at the sense instant tsi, and the properties of the light sources Li. These properties may change over time, for example due to temperature effects or aging.

The controller 3 has many possibilities to control the driver 2 such that a desired luminance of the light sources Li is obtained. For example, the light sources Li may be activated one by one such that periods in time exist during which only a single one of the light sources Li emits light. Because the distance LSi between the single active light source Li and the sensor 4 is known, the sensed signal SES can be corrected by using a weighting factor for this distance LSi. The power Pi supplied to the single active light source Li can be adapted to obtain the desired luminance. This adaptation can be a trial and error approach. If is detected that the luminance LUi of the light source Li is too low, the power Pi is increased a particular amount, and again the luminance LUi is sensed and the power Pi is adapted until the desired luminance LUi is reached sufficiently accurate. Although, such an approach of having the light sources Li active one by one is usually not feasible during normal operation, it might be very useful at the start of operation of the system.

Alternatively, a function F (see FIG. 3) indicating the luminance LUi of the light source Li as function of the power Pi supplied to this light source Li may be used. If both this function F and the weighting factors WF (see FIG. 3) are known, the power Pi required to compensate for the difference between the sensed luminance LUi and the desired luminance can be calculated directly. Further, if the functions F are known but the weighting factors WF are not known, it is possible to determine the weighting factors WF by supplying an identical power Pi to each one of the light sources Li one by one. The weighting factors WF may vary over time. If the weighting factors WF are well known, in the same manner it is possible to determine the functions F. These functions F may be different for different light sources Li and may vary over time. The variations of the weighting factors WF or the functions F over time, thus can be tracked by regularly performing a sense cycle with well known powers Pi. The number of sense signals SES required to be sensed at different powers Pi depends on the complexity of the functions F. If the behavior of the light sources Li is sufficiently accurately approximated by a linear function F with a single term a single measurement suffices. The different measurements may be performed during a special test period, which for example is performed every time the system is switched on. Alternatively, the different measurement may be performed during normal operation of the system. Care has to be taken that the different powers Pi are as less visible as possible. For example, the different powers Pi may be compensated by different duty cycles of the drive signals Di. For example, if the power Pi is halved, the duty cycle is changed from 0.5 to 1. Some compensation may also be possible in the data signals C1 to Cm send to the matrix display 1.

In another example, several adjacent light sources Li are active during a same period in time. The sensed signal SES represents the sum of the luminance LUi of all these active light sources Li at the position of the sensor 4. Now, the luminance at the position of the sensor 4 is a weighted sum ΣWFi*Fi(Pi) of functions F(Pi), one weighting factor WFi and function Fi(Pi) for each active light source Li. The weighting factors WFi of the weighted sum depend on the distances LSi between the light sources Li and the position of the sensor 4 and are also referred to as the weighting factor WF. The functions Fi(Pi) provide the luminance of the light sources as function of the power Pi supplied and are also referred to as F. The operation of the controller 3 in this construction is elucidated with respect to FIGS. 4 and 5.

Figure 2:
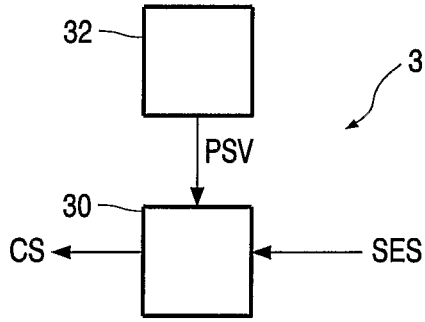
FIG. 2 shows an embodiment of the controller of the scanning backlight unit.

FIG. 2 shows an embodiment of the controller 3 of the scanning backlight unit (BU). The controller 3 comprises a memory 32 and a comparator 30. The memory comprises pre-stored values PSV which indicate for the sensing instants tsi what the value of the sensed signal SES should be. The comparator 30 receives the sensed signal SES and the pre-stored values PSV to supply the control signal CS to the driver. The comparator 30 corrects at each one of the sensing instants tsi any deviation between the sensed signal SES and the associated pre-stored (desired) value PSV by indicating via the control signal CS to the driver 2 to adapt the power Pi supplied to the light source Li accordingly. Usually, this is an iterative approach. Especially if groups of light sources Li are active during the same periods in time, and if these periods in time of different groups of light sources Li overlap, it may take some time to find the optimal power Pi for each light source Li.

Figure 3:
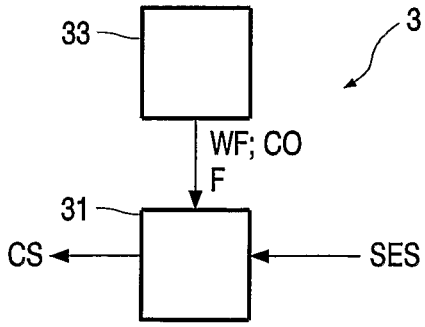
FIG. 3 shows another embodiment of the controller of the scanning backlight unit.

FIG. 3 shows another embodiment of the controller 3 of the scanning backlight unit (BU). Now, the controller 3 comprises a memory 33 and a calculation unit 31. The memory 33 stores the weighting factors WF and the functions F which determine the luminance LUi of the light sources Li as a function of the power Pi. Instead of actually storing the functions F it may suffice to store the coefficients CO of the function F if the calculation unit 31 knows what the structure of the function F is. Now, the calculation unit 31 can easily calculate the calculated luminance from the known structure of the function F, its coefficients CO, and the weighting factors WF.

For example, if the light sources Li are active one after the other, always only a single light source Li contributes to the sensed signal SES. The calculation unit 31 uses the actual power Pi supplied to the light source Li, the associated weighting factor(s) WF and the associated function F to determine the calculated luminance. The weighting factor WF is pre-determined by the distance LSi between the light source Li and the position of the sensor 4. The function F is predetermined dependent on the kind and type of light source Li used. The calculated luminance is compared with the sensed luminance which is determined by the sensed signal SES. If the calculated luminance deviates from the sensed luminance, the power Pi has to be adapted via the control signal CS. Again this may be an iterative process.

For example, if the light sources Li are activated one after the other but have overlapping periods in time during which they are active (see for example FIG. 4) again a system of equations occurs from which the coefficients CO can be determined. Once the coefficients CO are known, the powers Pi supplied to the light sources Li can be adjusted such that the desired luminance is obtained.

Figures 4A, 4B, 4C, 4D, 4E:
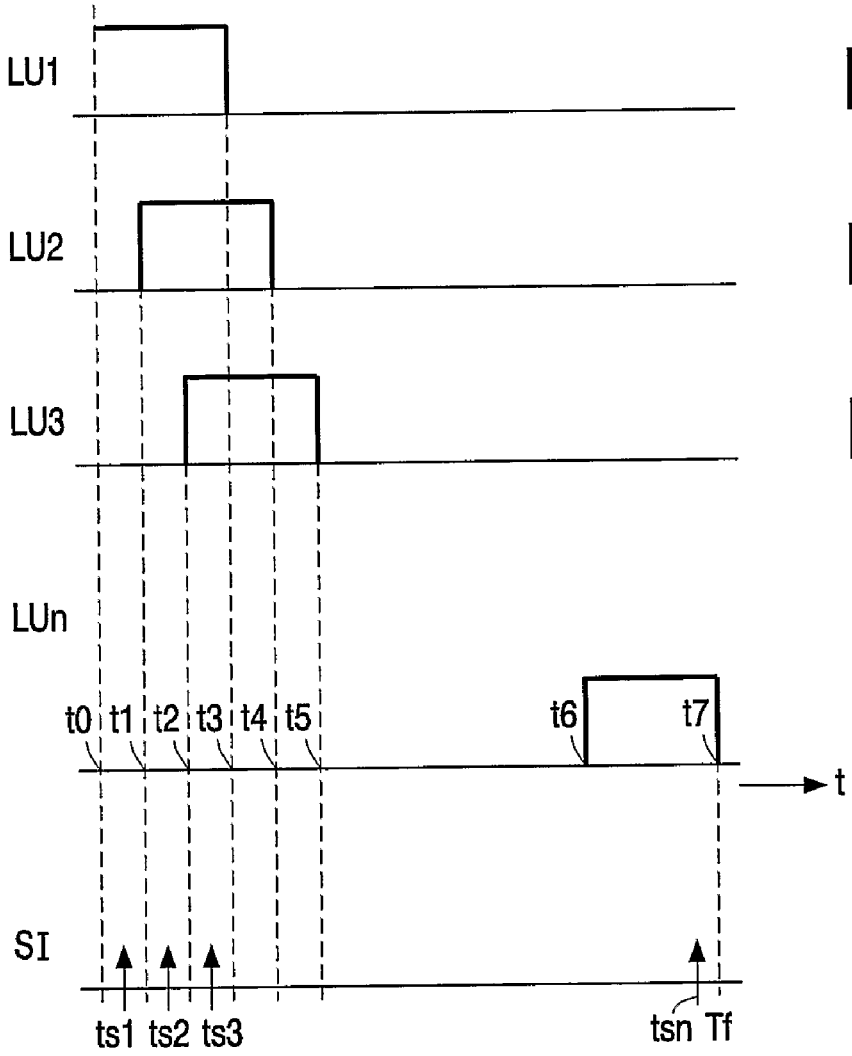
FIGS. 4A to 4E show different groups of light sources which have a luminance being fixed in time but occurring during different periods in time, and the associated sensing instants at which the luminance is sensed by the sensor.
Figure 5A:
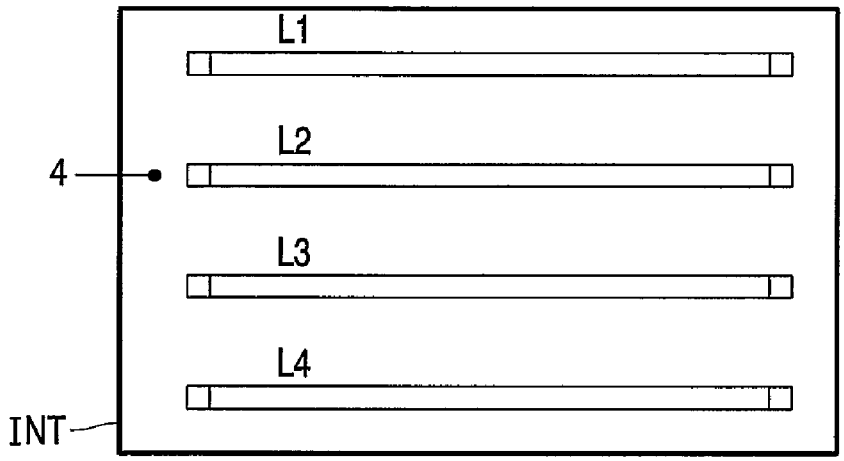
FIGS. 5A-5F show different groups of light sources which have a luminance varying in time and occurring during different periods in time, and the associated sensing instants at which the luminance is sensed by the sensor.
Figure 5B:
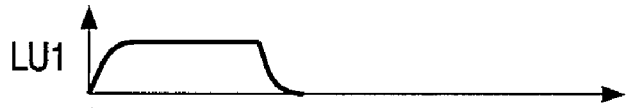
Figure 5C:
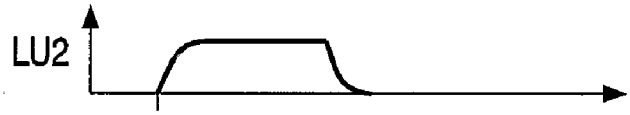
Figure 5D:
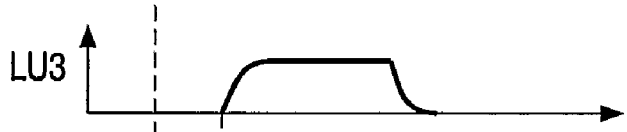
Figure 5E:
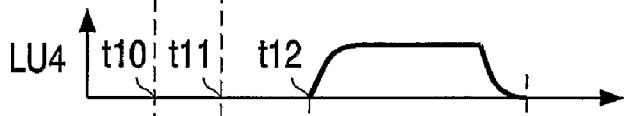
Figure 5F:
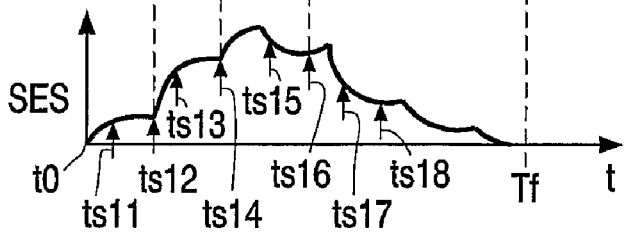

The FIG. 4 show different groups of light sources Li which have luminances LUi as function of time t being fixed in time within a frame period Tf but which occur during different periods within the frame period Tf. FIG. 4 further show the associated sensing instants tsi (ts1 to tsn) at which the luminance is sensed by the sensor 4. FIG. 4A shows the period in time lasting from t0 to t3 during which the light source L1 emits light with a luminance LU1. FIG. 4B shows the period in time lasting from t1 to t4 during which the light source L2 emits light with a luminance LU2. FIG. 4C shows the period in time lasting from t2 to t5 during which the light source L3 emits light with a luminance LU3. FIG. 4D shows the period in time lasting from t6 to t7 during which the light source Ln emits light with a luminance LUn. FIG. 4E shows an example of possible sense instants ts1, ts2, ts3, . . . , tsn. In this example, the sense instants tsi are selected in-between the instants t0, t1, t2, t3, . . . , t7, respectively. Thus, during the period in time from the instant t2 to t3, the three light sources L1, L2, L3 contribute to the luminance sensed by the sensor 4 at the sense instant ts3. By equating the sensed luminance at each of the sense instants ts1, ts2, ts3, . . . , tsn to the calculated luminance, the system of equations is obtained from which the coefficients CO can be solved.

This is elucidated with a simple example wherein the backlight unit BU only comprises four light sources L1 to L4 which are elongated lamps extending in the horizontal direction. This example is not shown in FIG. 4, and the sense instants ts1 to ts4 used in this example are not identical to the sense instants ts1 to ts4 shown in FIG. 4. The luminance functions Fi defining the luminance LUi of the lamps Li as function of the power Pi each consist of a multiplication of a single coefficient COi with the power Pi: LUi=Fi(Pi)=COi*Pi with i=1, 2, 3 or 4. The sensor 4 has a zero vertical distance LSi with respect to the lamp L2 (see FIG. 5A). The intensity of a lamp Li halves over the vertical distance between two adjacent lamps Li. Thus the weighting factor WF of the lamps L1 and L3 is 0.5, of the lamp L2 is 1, and of the lamp L4 is 0.25. The on-time of each lamp Li is half the frame time Tf. At the first sense instant ts1 the lamps L1 and L2 are active and generate a luminance L(ts1). At the second sense instant ts2 the lamps L2 and L3 are active and generate a luminance L(ts2). At the third sense instant ts3 the lamps L3 and L4 are active and generate a luminance L(ts3). And, at the fourth sense instant ts4 the lamps L4 and L1 are active and generate a luminance L(ts4). Consequently, the next four equations are valid:

$$L(ts1)=0.5*CO1*P1+CO2*P2$$

$$L(ts2)=CO2*P2+0.5*CO3*P3$$

$$L(ts3)=0.5*CO3*P3+0.25*CO4*P4$$

$$L(ts4)=0.5*CO1*P1+0.25*CO4*P4$$

It is clear that the coefficients CO1 to CO4 can be determined from these four equations. Once the coefficients CO1 to CO4 have been determined it is possible to adapt the powers P1 to P4 such that the luminance L(ts1) to L(ts4) get their desired levels. Consequently, also the luminance LU1 to LU4 will have the desired levels.

However, the sensor 4 may not be calibrated and thus the exact value of the luminance L(ts1) to L(ts4) derived from the sensed signal SCS at the different sense instants ts1 to ts4 is unknown. Usually, the sensor 4, which, for example, is a photodiode, has a linear behavior, and it is not required to know the absolute display luminance. Thus, in principle, no correction is required. Nevertheless, a possible approach may be to set a norm for the smallest coefficient COi to one which means that the lamp Li with the lowest luminance LUi is powered with the nominal power Pi. The other lamps Li will be driven with a power Pi which is reduced with a same factor.

To improve the accuracy of the sensing and to prevent disturbances and overshoot, the adaptation of the powers Pi may be performed slowly by averaging the coefficients COi determined, for example, during a number of frame periods.

It is possible to determine the weighting factors WFi of the light sources Li at the position of the sensor 4 automatically. This is especially important if the weighting factors WFi are not sufficiently accurately known due to mechanical tolerances. This is particularly simple if the light sources Li are sufficiently equal when new. The controller 3 may be arranged to sense the luminance with coefficients COi which all have a same predetermined value, preferably one. Now it is possible to determine the weighting factors WF from the system of equations. Subsequently, the determined weighting factors WF may be stored in a memory 33 for further use.

FIG. 5 show different groups of light sources Li which have a luminance LUi varying in time and which are active during different periods in time. FIG. 5 further show the associated sensing instants tsi at which the luminance LUi is sensed by the sensor 4. FIG. 5A shows, by way of example, a simple construction of the backlighting unit BU. The backlight unit BU only comprises four light sources L1 to L4 which are elongated lamps extending in the horizontal direction. The sensor 4 has a zero vertical distance with respect to the lamp L2. FIGS. 5B to 5E show, by way of example, a time t dependent luminance LU1 to LU4 of the lamps L1 to L4, respectively during a frame period Tf. FIG. 5F shows the sensing instants ts11 to ts18 at which a sensing signal SES is sensed.

The first lamp L1 is activated at the instant t0, the second lamp L2 is activated at the instant t10, the third lamp L3 is activated at the instant t11, and the fourth lamp L4 is activated at the instant t12. The luminance LUi of each one of the lamps L1 to L4 is returned to zero after half the frame period Tf from the respective activation instant ti.

For the ease of elucidation, the switch-on and switch-off behavior of the lamps L1 to L4 is identical. The behavior of the lamps L1 to L4 may be different. It is shown that two sense operations are performed per sense period which is the period between two successive switch-on instants ti of adjacent ones of the lamps L1 to L4. For example, the two luminance values LUi are sensed at the instants ts13 and ts14 within the sense period lasting from the instants t10 to t11. Because the luminance LU1 has a fixed value during this sense period, the change of luminance is completely due to the luminance of the lamp L2. From the two sense values it is possible to determine the time constant involved in the luminance variation of the lamp L2. It is possible to perform more sense operations during a same sense period if a more complex time behavior should be modeled. The controller 3 is able to reproduce this time variant behavior of the lamps L1 to L4 with a variable time constant.

Again a system of equations is available by equating the sensed luminance values at the sense instants tsi to the weighted sum of the functions Fi providing the luminance LUi of each lamp Li in dependence on the power Pi supplied to it. The coefficients COi and the time constants can be determined from this system of equations. This enables to calculate the on-time required to obtain a predefined luminance LUi, which is important if dynamical control of the luminance LUi is implemented. The dynamical control of the luminance LUi may be advantageously used to improve the grey level resolution in dark scenes. In dark scenes, the luminance of the backlighting is decreased allowing more grey levels to be used in the data to reach the desired luminance. In a scanning backlight unit BU, the dimming of the backlight may be obtained by shortening the on-time of the light sources Li. The on-time may be shortened for all light-sources Li of the backlighting unit BU with a same factor, or may be different per light-source.

It is also possible to use more than two sense instants tsi per sense period, for example when the switch-on time-constant differs from the switch-off time-constant. Now, the time behavior of the light sources Li is known, and it is possible to provide a feed-forward compensation of the power Pi supplied to the light sources Li to obtain a faster impulse response.

If the light sources Li have a non-linear behavior between the luminance LUi and the power Pi supplied to it, again, the luminance LUi has to be sensed several times to be able to determine the multiple coefficients COi involved. This is especially relevant if the light sources Li have to be dimmed over a large luminance range. If these sense operations have to be performed during normal operation, periods in time should be present wherein different dimming levels are present and thus different power/luminance values are available. Otherwise the controller 3 should generate test signals to supply different powers Pi to the same light source Li during successive frames and to correct the duty cycle such that the varying power Pi is substantially invisible.

Thus, if in normal operation the power Pi varies often, the sensing values SES of different periods in which the power Pi is different can be used to obtain a system of equations of higher order (with more than one coefficient COi). For example, if both a cycle with full power Pi and a cycle with half the power Pi is available for the same light source Li, it is possible to calculate the coefficients CO1 and CO2 of the next linear equation of the luminance LUi of the light source Li and the power Pi supplied to this light source Li $$LUi=CO1+CO2*Pi$$

Alternatively, if in normal operation the power Pi does not change, or changes too little, the controller 3 supplies test signals. For example, the controller 3 may both dim the light source Li and increase its on-time correspondingly to compensate for the lower luminance LUi. If the controller 3 knows the switch-on behavior of the light source Li, it is possible to generate these test signals without any visible disturbance.

The luminance contribution of the different light sources Li at the position of the sensor 4 may vary during the life-time of the light sources Li due to different temperature load of the light sources Li, different UV-shares in the light emitted, and dust. These effects can be detected if two or more sensors 4, 40, 41 (see FIG. 6), positioned at different positions are used. The extra system(s) of equations can be used to determine such effects. Usually, at the switch-on instant of the backlighting unit BU, all the light sources Li have the same characteristics (for example, the lamps Li all have the same temperature). The influence of the position and dust effects can be determined by performing a reference scan directly after the switch-on of the backlighting unit BU. As long as no picture is displayed, this can be performed very simple by activating the light sources Li one by one and having no overlap in the on-times of the light sources Li.

If the characteristics of the backlighting unit BU change slowly, the sensing has to be repeated at a rate sufficiently high to track these changes. Especially if dynamical backlighting is used these effects may become relevant. The temperature of each one of the lamps Li may change in a time window of a few seconds dependent on the average power in each one of the lamps Li, separately. The ambient temperature in the reflector changes dependent on the total average power in all the lamps Li in a time window of minutes, which also has an effect on the temperature of the lamps Li.

In a practical embodiment, preferably, a lot of effects are compensated at the same time. Thus, the model describing the luminance of the light sources Li as function as the power Pi and the related time effects should accurately cover the light sources Li used. The number of sensing instants tsi has to be selected sufficiently high to allow to cover the time dependence and/or non-linear behavior of the light sources Li. If required, test signals may be generated to be able to sense the luminance values LUi required to obtain sufficient equations to be able to determine the coefficients CO. Although such an optimal solution seems to be quite complex, the controller 3 can be a small and simple circuit because the change rate is quite low and thus ample time is available to perform the calculations required.

Figure 6:
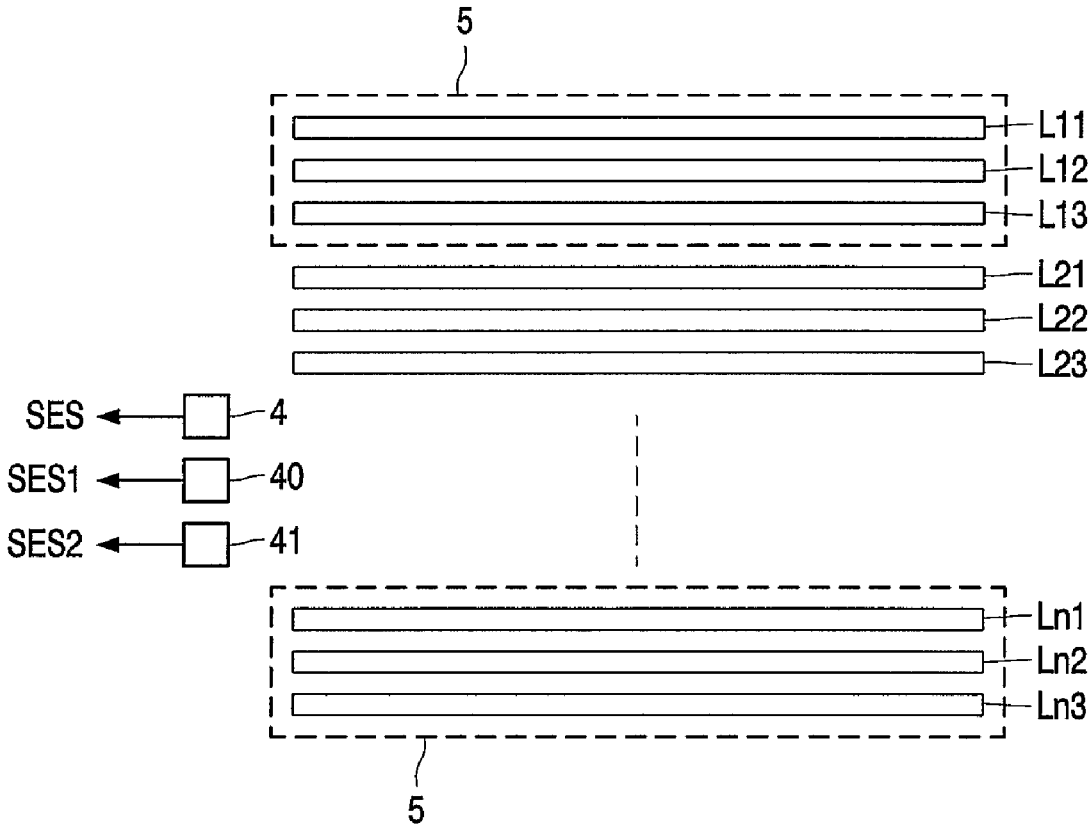
FIG. 6 shows a scanning backlight unit for a full color matrix display in which three light sensitive sensors are used.

FIG. 6 shows a scanning backlight unit BU for a full color matrix display in which three light sensitive sensors 4, 40, 41 are used. Now, the light sources Li comprise different groups 5 of light emitting elements Lij which emit a different color. By way of example, FIG. 6 shows that each group 5 comprises three light emitting elements Lij. Only two groups are indicated, one, at the top of the backlighting unit BU, comprises the light emitting elements L11, L12, L13, the other, at the bottom of the backlighting unit, comprises the light emitting elements Ln1, Ln2, Ln3. The light emitting elements L11 to Ln1 emit light with a first color, for example red. The light emitting elements L12 to Ln2 emit light with a second color, for example green. The light emitting elements L13 to Ln3 emit light with a third color, for example blue.

Although it is possible to use a single sensor 4 which is sensitive to all the three colors, FIG. 6 shows an embodiment in which three sensors 4, 40, 41 are used which are sensitive to only the first, second, and third color, respectively, and not to the other ones of the colors. The sensor 4 supplies a sense signal SES, the sensor 40 supplies a sense signal SES1, and the sensor 41 supplies a sense signal SES2. The controller 3 receives the sense signals SES, SES1, SES2 and may perform any of the tasks described hereinbefore, but now for each color separately. Further, the controller 3 may track the ratio of the luminance values sensed to keep the ratio of the contributions of the different colors equal to a desired ratio at which the desired white color point is obtained. It is possible that more than 3 different colored light emitting elements are present.

FIG. 7 shows a matrix display. The matrix display 1 comprises an array of pixels 10 associated with intersections of select electrodes R1 to Rn and data electrodes C1 to Cm. A particular select electrode or the select electrodes collectively is/are indicated by Ri, it will be clear from the context what is meant. A particular data electrode or the data electrodes collectively is/are indicated by Cj, again, it will be clear from the context what is meant. In the example shown, the select electrodes Ri are the row electrodes and the data electrodes Cj are the column electrodes. Alternatively, the select electrodes Ri may extend in the column direction and the data electrodes Cj may extend in the row direction.

A select driver SD supplies select voltages to the select electrodes Ri. A data driver DD supplies data voltages to the data electrodes Cj. A controller CT receives an input signal IS to be displayed on the matrix display 1, supplies a control signal CTO2 to the select driver SD, and supplies a control signal CTO1 to the data driver DD. The controller CT controls the select driver SD and the data driver DD such that the image information contained in the input signal IS is displayed on the matrix display 1. Usually the select driver SD selects the rows of pixels 10 one by one while the data driver DD supplies the data signals to the data electrodes Cj in parallel to the selected row of pixels 10. The period in time the light sources Li are active is synchronized with the selection of the rows of pixels 10. The matrix display 1 may be a monochrome display or a color display. The matrix display may be an liquid crystal display.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A scanning backlight unit (BU) for a matrix display (1), the scanning backlight unit (BU) comprising:

a plurality of light sources (L1, . . . , Ln), a driver (2) for supplying drive signals (D1, . . . , Dn) to the light sources (L1, . . . , Ln), a controller (3) for controlling the driver (2) to separately activate the light sources (L1, . . . , Ln) to obtain light-emitting regions (5) being active, and a light sensor (4) being associated with a group of at least two of the light sources (L1, . . . , Ln) to supply a sensor signal (SES) indicating a luminance (LU) of the group to the controller (3), the controller (3) being arranged for reading the sensor signal (SES) at different instants (ts1, . . . , tsn) at which mutually different subsets of the light sources (L1, . . . , Ln) of the group are active, to control the driver (2) for supplying power levels to the light sources (L1, . . . , Ln) of the group for obtaining a luminance (LU1, . . . , LUn) of each one of the light sources (L1, . . . , Ln) of the group in dependence on the sensor signal (SES).

2. A scanning backlight unit (BU) as claimed in claim 1, wherein the controller (3) is arranged for controlling the driver (2) to supply the power levels for obtaining a substantially equal luminance (LU1, . . . , LUn) of each one of the light sources (L1, . . . , Ln).

3. A scanning backlight unit (BU) as claimed in claim 1, wherein the controller (3) comprises a memory (32) for storing pre-stored values (PSV), and a comparator (30) for comparing the sensor signal (SES) or a signal derived from the sensor signal (SES) at the different instants (ts1, . . . , tsn) with the pre-stored values (PSV) to control the power levels supplied to the light sources (L1, . . . , Ln) for minimizing differences between the sensor signal (SES) or the signal derived from the sensor signal (SES) and the pre-stored values (PSV).

4. A scanning backlight unit as claimed in claim 1, wherein the controller (3) further comprises a calculator (31) for solving a system of equations obtained by equating the sensor signal (SES) for each one of the different instants (ts1, . . . , tsn) to an associated weighted sum (WS) of functions (F) indicating a luminance (LU1, . . . , LUn) of the different light sources (L1, . . . , Ln) as function of the power level (Pi) supplied, weighting factors (WF) of the weighted sum (WS) being dependent on a distance (di) between the position of the light sensor (4) and the respective ones of the light sources (L1, . . . , Ln).

5. A scanning backlight unit (BU) as claimed in claim 4, wherein the controller (3) further comprises a memory (33) for storing said weighting factors (WF) and/or said functions (F).

6. A scanning backlight unit (BU) as claimed in claim 4, wherein the controller (3) is arranged for controlling the driver (2) to supply predetermined power levels to active ones of the light sources (L1, . . . , Ln), and wherein the calculator (31) is arranged for determining said weighting factors (WF) from the system of equations.

7. A scanning backlight unit (BU) as claimed in claim 4, wherein the controller (3) is arranged for controlling the driver (2) to supply a predefined power to said light sources (L1, . . . , Ln) one by one, and wherein the calculator (31) is arranged for determining said functions (F) for the different light sources (L1, . . . , Ln).

8. A scanning backlight unit (BU) as claimed in claim 7, wherein the controller (3) is arranged for controlling the driver (2) to supply an identical predefined power level to said light sources (L1, . . . , Ln), and wherein the calculator (31) is arranged for determining, from the sensor signal (SES) at the different instants (ts1, . . . , tsn), said functions (F) being a polynomial with a single term of the power level (Pi).

9. A scanning backlight unit (BU) as claimed in claim 7, wherein the controller (3) is arranged for controlling the driver (2) to supply a plurality of predefined power levels to each one of said light sources (L1, . . . , Ln), and wherein the calculator (31) is arranged for determining said functions (F) from the associated sensor signals (SES).

10. A scanning backlight unit (BU) as claimed in claim 4, wherein the calculator (31) is arranged for determining the functions (F) by using the sensor signal (SES) at corresponding instants in different scan periods (Tf) at which different power levels (Pi) are supplied to the active ones of the light sources (L1, . . . , Ln), each one of the different scan periods (Tf) being a period in time required for a repetitive sequence of activating all the light sources (L1, . . . , Ln).

11. A scanning backlight unit (BU) as claimed in claim 4, wherein the controller (3) is arranged for retrieving a plurality of sensor signals (SES) at a corresponding plurality of instants (ts11, . . . , ts18) at which the same one of the light sources (L1, . . . , Ln) of the group is active to obtain a plurality of systems of equations determining a time behavior of the luminance (LU1, . . . , LUn) of said light sources (L1, . . . , Ln).

12. A scanning backlight unit (BU) as claimed in claim 4, wherein the controller (3) is arranged for controlling the driver (2) to supply a predefined power level to said light sources (L1, . . . , Ln) by supplying a drive signal (D1, . . . , Dn) having different duty cycles at corresponding instants in different scan periods (Tf) to the associated light sources (L1, . . . , Ln), and wherein the calculator (31) is arranged for determining said functions (F) from the sensor signal (SES) at said corresponding instants in the different scan periods (Tf), each one of the different scan periods (Tf) being a period in time required for a repetitive sequence of activating all the light sources (L1, . . . , Ln).

13. A scanning backlight unit (BU) as claimed in claim 1, comprising a single light sensor (4) being positioned to receive light of each one of the light sources (L1, . . . , Ln).

14. A scanning backlight unit (BU) as claimed in claim 1, wherein the light sources (L1, . . . , Ln) comprise first light sources (L11, . . . , Ln1) emitting light having a first color (R) and second light sources (L12, . . . , Ln2) emitting light having a second color (G) being different from the first color (R), the controller (3) being arranged for time sequentially activating said first light sources (L11, . . . , Ln1) and said second light sources (L12, . . . , Ln2), and wherein the single sensor (4) is sensitive to both light having the first color (R) and light having the second color (R).

15. A scanning backlight unit (BU) as claimed in claim 1, wherein the light sources (L1, . . . , Ln) comprise first light sources (L11, . . . , Ln1) emitting light having a first color (R) and second light sources (L12, . . . , Ln2) emitting light having a second color (G) being different from the first color (R), and wherein the scanning backlight unit (BU) comprises a further sensor (40) being sensitive to light having the second color (G), the first mentioned sensor (4) being sensitive to light having the first color (R), and wherein the controller (3) is arranged for controlling the driver (2) for time sequentially activating said first light sources (L11, . . . , Ln1) and said second light sources (L12, . . . , Ln2).

16. A scanning backlight unit (BU) as claimed in claim 15, wherein the controller (3) is arranged for controlling a ratio of on the one hand power levels supplied to the first light sources (L11, . . . , Ln1) and on the other hand power levels supplied to the second light sources (L12, . . . , Ln2) in dependence on sensor signals (SES) of the first mentioned sensor (4) and further sensor signals (SES1) of the further sensor (40), respectively, to obtain a substantially constant ratio between the luminance of the first light sources (L11, . . . , Ln1) and the second light sources (L12, . . . , Ln2).

17. A scanning backlight unit (BU) as claimed in claim 1, wherein the light sources (L1, . . . , Ln) are lamps.

18. A scanning backlight unit (BU) as claimed in claim 17, wherein the lamps (L1, . . . , Ln) have an elongated shape and a single lamp is associated with a single one of the light-emitting regions (5).

19. A scanning backlight unit (BU) as claimed in claim 1, wherein each one the light sources (L1, . . . , Ln) comprises a plurality of light emitting elements.

20. A scanning backlight unit as claimed in claim 19, wherein the light emitting elements are light emitting diodes.

21. An apparatus comprising a matrix display device (1) and the scanning backlight unit (BU) as claimed in claim 1 for lighting the matrix display device (1).

22. A method of illuminating a matrix display (1) with a scanning backlight unit (BU) comprising light sources (L1, . . . , Ln) and a light sensor (4) being associated with a group of at least two of the light sources (L1, . . . , Ln) to supply a sensor signal (SES) indicating a luminance at a position of said sensor (4), the method comprises supplying (2) drive signals to the light sources (L1, . . . , Ln) to separately activate the light sources (L1, . . . , Ln) to obtain light-emitting regions (5) being active, reading (3) the sensor signal (SES) at different instants (ts1, . . . , tsn) at which a different subset of the light sources (L1, . . . , Ln) of the group are active, and controlling (3) the supplying (2) to supply power levels to the light sources (L1, . . . , Ln) of the group for obtaining a luminance (LU1, . . . , LUn) of each one of the light sources (L1, . . . , Ln) of the group in dependence on the sensor signal (SES).

* * * * *